United States Patent [19]

Albrecht

[11] Patent Number: 4,459,768

[45] Date of Patent: Jul. 17, 1984

[54] BUCKET DESIGN

[75] Inventor: Allan J. Albrecht, Rothschild, Wis.

[73] Assignee: J. I. Case Company, Racine, Wis.

[21] Appl. No.: 462,623

[22] Filed: Jan. 31, 1983

[51] Int. Cl.[3] ..... E02F 3/28

[52] U.S. Cl. ..... 37/118 R; 37/141 R; 414/722

[58] Field of Search ..... 37/118 R, 141 R, 141 T; 414/722, 723, 726

[56] References Cited

U.S. PATENT DOCUMENTS

| | | | |
|---|---|---|---|
| 4,081,092 | 3/1978 | Zimmerman | 414/722 X |
| 4,081,919 | 4/1978 | Teach | 37/141 R |
| 4,111,320 | 9/1978 | Breeding | 414/722 |
| 4,271,614 | 6/1981 | Albrecht | 37/141 T X |
| 4,329,797 | 5/1982 | Shumaker | 37/118 R |

OTHER PUBLICATIONS

S.A.E. Standard, SAE J49 5/1978.

S.A.E. Recommended Practice, SAE J1179, approved 3/1977.

*Primary Examiner*—Edgar S. Burr

*Assistant Examiner*—Moshe I. Cohen

*Attorney, Agent, or Firm*—Dressler, Goldsmith, Shore, Sutker & Milnamow, Ltd.

[57] ABSTRACT

A bucket design is disclosed having side walls including forward leading portions which are forward of a strike plane defined by the bottom edge of the bucket and its rotation axis. The forward leading portions can contact the soil and provide a greater break out force than that available at the bottom edge. An improved wear strip design is also disclosed.

7 Claims, 3 Drawing Figures

50
58
16
56
42
52
B
44
54
46
Q
48
28
Z
62
Y
S
S1
D
22
A
W1
24
X
W
72
64
76
36
70
C
74
C1
34
32

BUCKET DESIGN

TECHNICAL FIELD

The present invention relates to buckets and scoops which are commonly used with earth moving apparatus such as backhoes and excavators.

BACKGROUND OF THE INVENTION

When digging through hard or compacted earth deposits such as clay or rocky soil, a large amount of force is often needed as the bucket first enters the deposit. This initial force is needed to force the leading portion of the bucket into the deposit so that the deposit may be broken up and collected in the bucket. Generally, the leading portion of the bucket is that portion which is most forward as the bucket is pivoted about its rotation axis. Usually, the leading portion of the bucket is defined by teeth on the bottom of the bucket.

This initial force, sometimes referred to as the breakout or digging force, is generally a function of the strength of the hydraulic motor which rotates the bucket and the distance between the leading portion and the bucket rotation axis. The greater the distance between the leading portion and the rotation axis, the lower the breakout force. Where the leading portion of the bucket is on the teeth, the breakout force is the same as the rated digging force. The rated digging force is defined by the digging force that can be exerted at the cutting point furthest from the rotation axis, usually the teeth. See SAE Recommended Practices, Hydraulic Excavator Digging Forces SAE J117, and Specification Definitions-Hydraulic Backhoes SAE J49.

The breakout force indicates how easily the bucket will penetrate into the earth so that it may be broken up and received within the bucket for removal. Therefore, it is desirable to maximize the breakout force such as by having the leading portion near the rotation axis. On the other hand, it is desirable to have the leading portion spaced away from the bucket rotation axis so that it will have a relatively large travel distance or amount of swing as the bucket is rotated. Teeth protruding forward from the bottom edge of the bucket have such a large travel distance. Unfortunately, while this provides the maximum amount of relative travel for the leading portion, i.e., teeth, it minimizes the possible breakout force produced by the bucket.

Another common problem with buckets used on excavators, backhoes and the like is that the bucket bottom portion behind the teeth tends to undergo excessive wear. This bottom portion is at about the same or slightly greater distance from the rotation axis as the forward edge of the bucket. As the bucket is rotated or the backhoe dipper stick swung, this bottom portion is forced into contact with the deposit which often contains abrasive material and grinds at the bottom surface of the bucket.

To solve this problem, various proposals have been made to place wear strips which extend longitudinally in the direction of rotation along the bottom and rearward portion of the bucket. These wear strips because of their design create additional frictional forces with the earth as well as add to the weight of the bucket. For the most part, these strips must be welded on the surface of the bucket. This limits replaceability and the choice of possible materials.

Accordingly, what is needed is a bucket which provides a leading portion which not only has a relatively large travel swing, but also provides an increased amount of breakout force as the bucket enters the deposit. It would also be desirable if the bucket were provided with a means to minimize wear which avoids the difficulties described above and can be replaceable. The present invention meets these desires.

SUMMARY OF THE INVENTION

The present invention is an earth working bucket for use on a lift arm assembly which can generally be found on backhoes, excavators, and the like. Generally, the bucket is rotatably mounted on the end of a dipper stick which itself may be swung through an arc.

The bucket embodying the present invention includes a pair of spaced apart lateral side walls contiguous with a bucket pan having a top edge, a rear portion, and a bottom edge. The side walls define forward leading portions which together with the top and bottom edges define an opening into a cavity defined by the side walls and the pan. The bucket pan is usually provided with teeth whose leading edges define the bottom edge. Mounting means is provided on the pan proximal the top edge for pivoting the bucket about a rotation axis. Pivoting is usually done by means of a hydraulic motor.

The bottom edge and rotation axis together define a strike plane which is in the vicinity of the opening defined by the leading portions and side walls. Each leading portion has an upper border and a lower border opposite with respect to an apex. The apex is spaced forward of the strike plane. As the bucket is rotated, the apex will usually be the first portion of the bucket to engage the soil as it is rotated. Since the apex is also closer to the rotation axis than the teeth, preferably about two thirds the distance, the breakout force is greater as the apex enters the soil than if the leading portion were at the bottom of the bucket.

The upper and lower borders are preferably generally straight forming a general wedge shape with the upper border extending approximately from the rotation axis to the apex and the lower border extending approximately from the bottom edge of the pan or the back of the teeth to the apex. This wedge shape design assists in forcing the bucket smoothly into the soil, i.e., sliding into the soil without any portions which would be generally parallel to the surface being dug into.

Since the upper border is preferably about two thirds of the length of the strike plane, the breakout force at the apex as it enters the earth is increased by about fifty percent. In addition, the amount of travel of the apex as the bucket is rotated about the rotation axis is still relatively large being only reduced by about 33 percent. The apex can therefore be driven into the soil at a higher breakout force without and still have sufficient travel to crumble the soil allowing it to be collected by the bucket for removal.

The bucket preferably is also provided with a transversely mounted wear strip on the pan rearwardly of the leading edge. The strip is best located on the bottom of the bucket pan in a region from about thirty degrees to about 60 degrees from the strike plane. This region is about the same distance or relative radius from the rotation axis of the bucket and the rotation axis of dipper stick as that portion of the pan immediately behind the teeth. Placing a wear strip on this portion of the pan helps avoid excessive wear on the bucket.

A transversely mounted wear strip protects the pan without need for a relatively large and heavy longitudinal strip welded on the bottom of the pan. The transversely mounted wear strip can be mounted on the pan by either being welded in place or attached by appropriate retaining means such as bolts.

Bolting the wear strip on the pan is particularly advantageous because a wider selection of materials for the wear strip are available and not limited by the effects of welding. As the wear strip becomes worn, it can be unbolted and replaced by a new wear strip without substantial difficulty. A plurality of such wear strips, such as a pair, can be mounted spaced apart on the bucket pan to provide maximum protection.

Numerous other advantages and features of the present invention will become readily apparent from the description of the preferred embodiment of the invention, the drawings, and the appended claims.

DESCRIPTION OF THE PREFERRED EMBODIMENT

Figure 1:
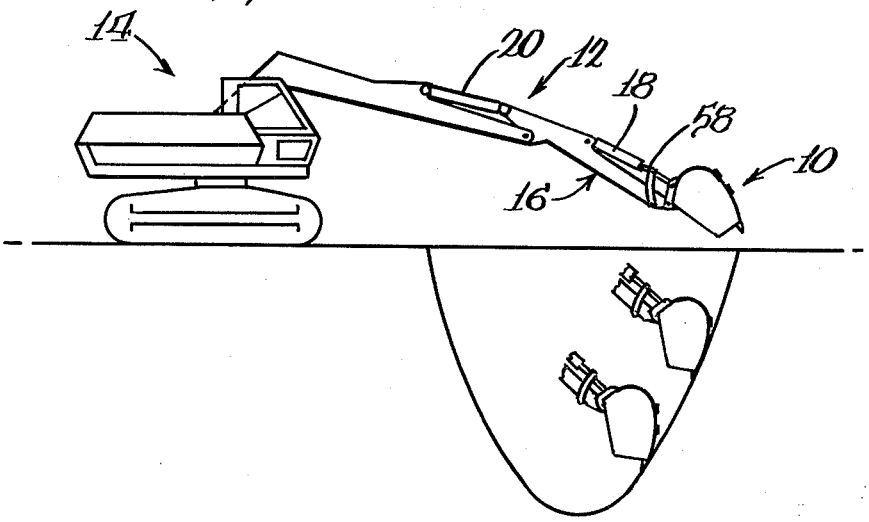
FIG. 1 is a side elevation view showing an excavator equipped with a bucket embodying the present invention.

While this invention can be embodied in many different forms, there are shown in the drawings and described in detail, a preferred embodiment of the invention. The present disclosure is an exemplification of the principles of the invention and is not intended to limit the invention to the embodiment illustrated.

Referring to FIG. 1, the present invention is an earth working bucket 10 for use on a lift arm assembly 12 which can be found on various types of earth moving equipment such as excavator 14. The bucket 10 is mounted on a dipper stick 16 and can be rotated by hydraulic motor 18. The dipper stick 16 can itself be moved through an arc by a second hydraulic motor 20. The operation of excavators and lift arms is well-known in the art and need not be discussed further.

Figure 3:
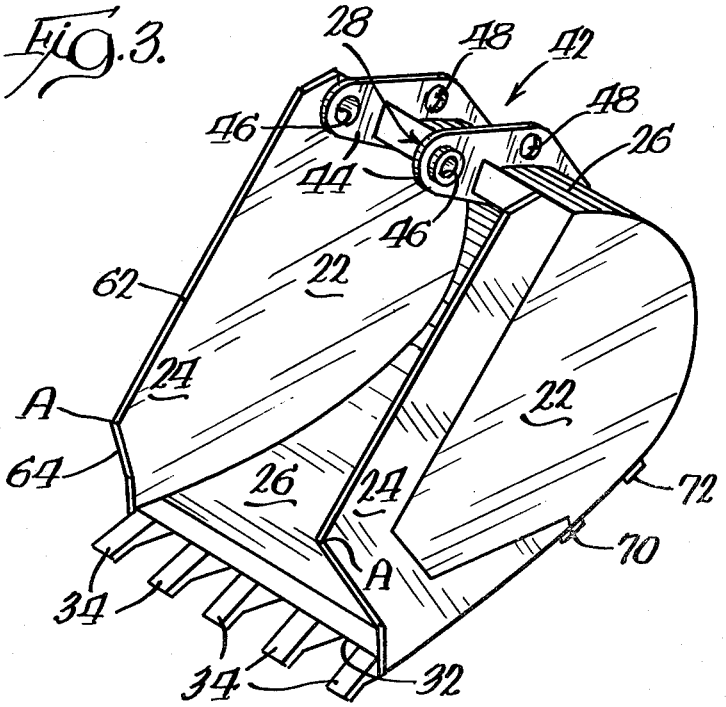
FIG. 3 is an enlarged perspective view showing the bucket which embodies the present invention.
Figure 2:
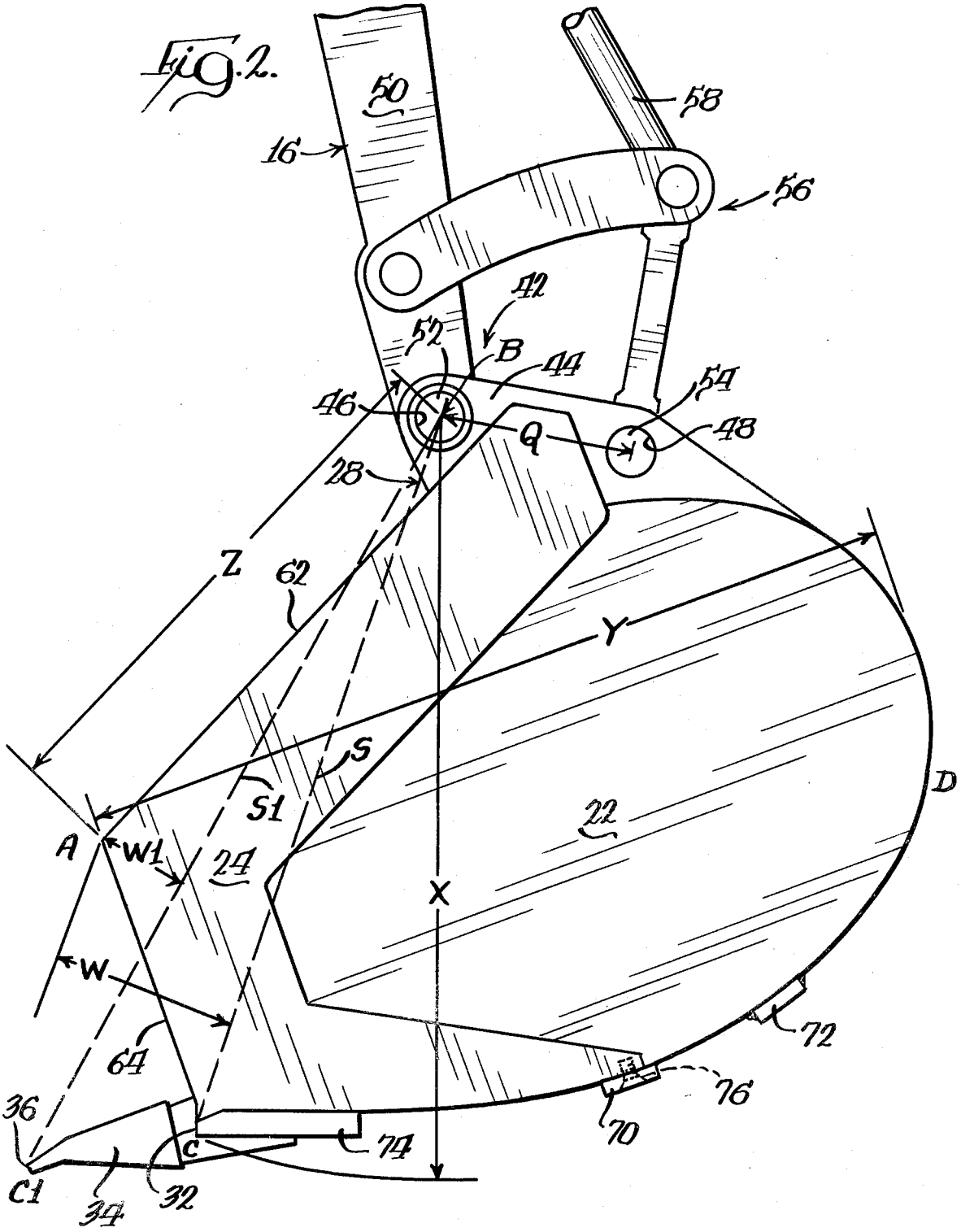
FIG. 2 is an enlarged side elevational view of the bucket embodying the present invention.

Referring to FIGS. 2 and 3, the bucket 10 of the present invention includes a pair of spaced-apart lateral side walls 22 each having a forward leading portion 24. Each forward leading portion 24 preferably includes a reinforcing plate to add thickness to the leading portion with respect to the remainder of the lateral side walls 22. This adds strength and rigidity and ensures that the leading portions 24 do not become bent and excessively worn during use.

The bucket 10 also includes an arcuate bucket pan 26 having a top edge 28 and a leading edge 32 which defines a bottom edge C. The top edge 28, the bottom edge C, and the leading portions 24 together define an opening into a cavity defined by the side walls 22 and the pan 26. The pan 26 can also include a plurality of teeth 34 in which case the leading forward edges 36 of the teeth define the bottom edge C1. The teeth 34 are advantageous, but not necessary for the operation of the bucket of the present invention.

The bucket 10 also includes mounting means 42 on the pan 26 proximal or near the top edge 28 for pivoting the bucket about a rotation axis at B. The mounting means preferably includes a pair of mounting members 44 which together define a pair of aligned apertures 46 and 48. The bucket 10 is mounted on the lift arm assembly dipper stick 16 by a rotation pin 52 the central axis of which defines the rotation axis B. The rotation pin 52 is preferably received on the fixed member 50 of the dipper stick 16 while a second pin 54 passes through aligned holes 48 to be associated with linkage 56 which connects to a rod 58 of hydraulic motor 18. Movement of the rod 58 with respect to the fixed member 50 of the lift arm causes the linkage 56 to rotate the bucket about the rotation axis B.

The bottom edge C (or when teeth are present C1) and rotation axis B together define a strike plane graphically shown by broken lines S and S1 respectively. The leading portions 24 each have an upper border 62 and a lower border 64 opposite with respect to an apex A. The apex A is spaced forward of the strike plane. This provides greater breakout force at the apex A where it contacts the ground to be broken.

The bucket torque, T, generated to turn the bucket 10 about the rotation axis B is equal to the force in the linkage 56 which is in turn generated by the hydraulic motor 18 times the distance between the axis of the second pin 54 and the rotation axis B which is shown as Q. Or, the bucket torque stated in a more mathematical form is:

$$T=F\times Q.$$

The breakout force which is generated at the apex A, $F_b$, is equal to the bucket torque divided by the distance between the apex and the rotation axis B. This distance as shown in FIG. 2 is Z. Stated mathematically, the breakout force $F_b$ is given by:

$$F_b=T/Z=(FQ/Z).$$

The breakout force of the apex A is greater than the force which would be generated at the bottom edge C if that was the first to contact the soil. The "breakout force" at C or C1 or rated digging force as it is also known would be correspondingly less since the distance from B to C is larger than Z. By placing the apex A spaced forward of the strike plane, the apex is the first part of the bucket to contact the ground when in a digging position. The breakout force available is thus greater than if the bottom edge C or C1 first contacted the ground.

The distance Z is preferably about equal to two-thirds of the distance between the rotation axis B and the bottom edge C as shown by X. This increases the breakout force by about fifty percent without substantial reduction, only about one-third, in travel swing of the apex. After the apex A breaks through the surface of the soil and generally loosens the material, the remainder of the bucket can collect the material for removal. This is particularly helpful when digging in difficult materials such as compacted clay or rocky soils.

The upper border 62 and lower border 64 are preferably substantially straight with the upper border extending substantially between the apex A and the rotation axis B and lower border 64 extending from the apex to leading edge 32 of the pan 26. The general wedge shaped design of the leading portions 24 assists in allowing the bucket 10 to slice into the soil without any edges which would be parallel to the soil surface and thus not cut into the soil easily.

The greater the distance that the apex A is in front of the strike plane, either W or W1, the greater the apex slices into the soil before the remainder of the bucket contacts the soil. It is preferred that the apex A be in front of the strike plane S by an amount, W, that is approximately one fourth the distance between the rotation axis and the bottom edge C. This provides the necessary concentration of breakout force without creating a bulky or excessively heavy bucket.

It is also preferred that the distance between the apex and the rear D of the bucket, i.e., distance Y, be greater than distance X from the rotation axis B to the bottom edge C. This, together with the general forward configuration of the leading portions 24, greatly increases the holding capacity of the bucket.

Referring to FIG. 2, one or more wear strips 70, 72 can be mounted on the bucket pan 26 rearwardly of the leading edge 32. The wear strips are mounted transversely and accordingly need not cover a large area on the bottom of the bucket 10. The wear strips 70, 72 preferably have a height approximately equal to or less than a reinforcing member 74 on the forward portion of the bucket. The wear strips are located on that portion of the bucket pan 26 which is approximately the same distance from the rotation axis as the forward portion of the bucket pan in the vicinity of the reinforcing member 74. The wear strips are approximately 30 degrees to about 60 degrees behind the strike plane with respect to the rotation axis. This provides greates protection to the bucket.

Because the wear strips can be attached by appropriate fastening means such as bolt 76 as shown at 70 or welded as shown at 72 to the bucket pan, a wide range of materials for the wear strips can be used. In addition, where the wear strip 70 is bolted to the bucket pan 26, should it become worn or otherwise damaged, it can be relatively easily removed and replaced with a new wear strip. This is not possible with longitudinally mounted wear strips which are welded in place.

Still other variations in the spirit and scope of this invention are possible and will readily present themselves to those skilled in the art.

What is claimed is:

1. An earth working bucket for use on a lift arm assembly, the bucket comprising an operative association:

a pair of spaced apart lateral sidewalls each having a forward leading portion, the sidewalls being continguous with a bucket pan having a top edge, a rear portion, and a bottom edge, the top and bottom edges together with leading portions of the sidewalls defining an opening into a cavity defined by the sidewalls and pan; and mounting means on the pan proximal the top edge for pivoting the bucket about a rotation axis; the bottom edge and rotation axis defining a strike plane and the leading portions having an upper border extending substantially from the rotation axis and a lower border extending substantially from the bottom edge, the upper and lower borders opposite with respect to an apex spaced forward of the strike plane, and wherein the distance between the apex and the rotation axis is more than one half the distance between the rotation axis and the bottom edge and the distance between the apex and the strike plane is about one fourth the distance between the rotation axis and the bottom edge.

2. The earth working bucket of claim 1 wherein the distance from the apex to the rear portion of the bucket is greater than the distance from the rotation axis to the bottom edge.

3. The earth working bucket of claim 1 wherein the pan includes a plurality of teeth each having a forward edge.

4. The earth working bucket of claim 1 wherein the upper and lower borders are substantially straight.

5. The earth working bucket of claim 4 wherein the distance between the apex and the rotation axis is about two thirds the distance between the rotation axis and the bottom edge.

6. The earth working bucket of claim 1 including at least one transversly mounted wear strip on the pan rearwardly of the leading edge.

7. The earth working bucket of claim 6 wherein the wear strip is mounted on the bottom portion of the bucket pan from about 30 degrees to about 60 degrees as measured from the strike plane with respect to the rotation axis.

* * * * *